US011896876B2

(12) United States Patent
Cholhan et al.

(10) Patent No.: US 11,896,876 B2
(45) Date of Patent: Feb. 13, 2024

(54) MODULAR ATTACHABLE AIRBAG COMPARTMENTS FOR WHOLE-BODY AVALANCHE PROTECTION SYSTEM

(71) Applicant: CHOPRIX LLC, Rochester, NY (US)

(72) Inventors: Hilary J. Cholhan, Rochester, NY (US); Remy A. Cholhan, Rochester, NY (US)

(73) Assignee: Hilary J. Cholhan, Rochester, NY (US)

( * ) Notice: Subject to any disclaimer, the term of this patent is extended or adjusted under 35 U.S.C. 154(b) by 344 days.

(21) Appl. No.: 17/364,166

(22) Filed: Jun. 30, 2021

(65) Prior Publication Data

US 2022/0001241 A1 Jan. 6, 2022

Related U.S. Application Data

(60) Provisional application No. 63/047,682, filed on Jul. 2, 2020.

(51) Int. Cl.

| | |
|---|---|
| ***A63B 29/00*** | (2006.01) |
| ***A41D 7/00*** | (2006.01) |
| ***A41D 13/00*** | (2006.01) |

(52) U.S. Cl.

CPC ..... *A63B 29/00* (2013.01); *A41D 7/00* (2013.01); *A41D 13/00* (2013.01)

(58) Field of Classification Search

CPC ..... A63B 29/00; A63B 71/00; A63B 71/08; A63B 71/10; A63B 71/12; A41D 13/00; A41D 7/00; A61G 9/00; A61B 5/00; A61B 5/11

USPC ..... 441/80

See application file for complete search history.

(56) References Cited

U.S. PATENT DOCUMENTS

| | | | | |
|---|---|---|---|---|
| 3,134,993 | A * | 6/1964 | McCoy | A41D 7/003 441/102 |
| 7,017,195 | B2 * | 3/2006 | Buckman | A61B 5/1117 2/455 |
| 7,150,048 | B2 * | 12/2006 | Buckman | A61B 5/1117 2/455 |
| 8,104,096 | B1 * | 1/2012 | Jenney | A41D 7/003 2/67 |
| 9,161,577 | B1 * | 10/2015 | Harper | A41D 13/0537 |
| 10,035,572 | B1 * | 7/2018 | Armendariz | A41D 13/0125 |
| 10,149,638 | B2 * | 12/2018 | Buckman | A61B 5/1117 |

* cited by examiner

*Primary Examiner* — Lars A Olson

(74) *Attorney, Agent, or Firm* — Heslin Rothenberg Farley & Mesiti P.C.; Rachel L. Pearlman, Esq.

(57) ABSTRACT

In one example, an airbag attachment unit (AAU) includes a body that defines an airbag compartment, an airbag disposed in the airbag compartment and configured to be selectively deployed from the airbag compartment, a closure mechanism configured to releasably close the airbag compartment, a tube at least partly disposed within the airbag compartment and connected to the airbag, and the tube having a quick-connect coupling mechanism configured to mate with a corresponding element of an airbag inflation system, and a portion of an attachment mechanism connected to the body and configured to releasably engage a corresponding portion of an attachment mechanism of an article of clothing such that the airbag attachment unit is detachably connectible to an exterior of the article of clothing.

19 Claims, 5 Drawing Sheets

MODULAR ATTACHABLE AIRBAG COMPARTMENTS FOR WHOLE-BODY AVALANCHE PROTECTION SYSTEM

FIELD OF THE INVENTION

The present disclosure is generally concerned with safety systems for use by snow sports participants and others. More specifically, at least some of the disclosed embodiments are concerned with a whole-body airbag system, including wearable inflatable lower body/lower extremity garments to provide whole-body flotation during avalanche incidents and/or potentially catastrophic high-impact crashes. Example embodiments may include one or more detachable airbag compartments that may be selectively attached to, and detached from, articles of clothing, backpacks, and other items.

BACKGROUND

Many outdoor activities, sports, recreations and pastimes pose inherent risks and dangers, especially while participating in such activities in avalanche-prone areas. In particular, snow sports enthusiasts and those engaged in mountaineering, that is, endeavors such as mountain hiking, skiing, ski mountaineering, snowboarding, snowmobiling and climbing, face the real dangers of becoming involved in an avalanche incident and/or high-impact crashes.

Relation of the Disclosure to the Appendix

Embodiments of the invention may be particularly useful when employed as part of, or supplemental to, airbag systems and components such as are disclosed in the Appendix hereto, which forms a part of the present disclosure. For example, any of the airbags disclosed herein may be substituted for any of the airbags disclosed in the Appendix. Likewise, any of the articles of clothing, backpacks, and other elements disclosed herein may be substituted, respectively, for the articles of clothing, backpacks, and other elements, disclosed in the Appendix. As well, the airbags disclosed herein may be connectible to, and operable with, airbag inflation systems and control systems such as are disclosed in the Appendix. However, the scope of the invention is not limited to applications such as those set forth in the Appendix. Rather, those are provided only by way of example. More generally, example disclosed embodiments may be employed wherever their structure and functionality may be useful.

Aspects of Some Example Embodiments

It should be noted that the embodiments disclosed herein do not constitute an exhaustive summary of all possible embodiments, nor does this brief summary constitute an exhaustive list of all aspects of any particular embodiment (s). Rather, this brief summary simply presents selected aspects of some example embodiments. It should further be noted that nothing herein should be construed as constituting an essential or indispensable element of any invention or embodiment. Rather, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s).

Nor should such embodiments be construed to implement, or be limited to implementation of, any particular technical effect(s) or solution(s).

In general, disclosed embodiments are concerned with a whole-body airbag system that may provide consistent protection not just to the caput, shoulders and upper torso, but comprehensive protection to the entire body, including the lower torso, pelvic region, and lower extremities. This is accomplished by way of a selectively inflatable lower body garment that, depending upon the embodiment, may or may not, be integrated together with an upper body protection/flotation system. Such embodiments may optimize short and long-term survivability in avalanche situations, high-impact falls, or other trauma-precipitating events. Some embodiments of the whole-body airbag system may include one or more detachable airbags that may be selectively attached to, and detached from, articles of clothing, backpacks, and other elements. The detachable airbags may be selectively connected to an airbag inflation system, examples of which are disclosed in the Appendix.

Example embodiments of the invention may provide any one or more of the various features and elements disclosed herein. Such features and elements include, but are not limited, those discussed immediately below, but no embodiment is required to include any particular feature or element. Particularly, example embodiments of an airbag attachment unit (AAU) such as the modular attachable airbag compartments disclosed herein and which may be employed with a whole-body inflatable airbag system, may include any one or more of the following features and elements:

1. an AAU comprising one or more airbags, and configured to be selectively attached to, and detached from, items such as an article of clothing such as, but not limited to pants, shorts, vests, jackets, and equipment such as backpacks;
2. an AAU comprising one or more airbags, one or more of which may include a quick connect/disconnect coupling for releasably attaching to an element of an airbag inflation system, such as may be included in a backpack for example;
3. an AAU comprising one or more airbags, and the AAU including a zipper, hook-and-loop material, or any other connection that may enable the airbag to be selectively attached to, and detached from, items such as an article of clothing or equipment that includes a complementary portion configured to engage the zipper, hook-and-loop material, or other connection;
4. an AAU comprising a snap or other retention mechanism configured to prevent a zipper from opening inadvertently;
5. an AAU comprising a protective sleeve within which an airbag is at least partly disposed, and the protective sleeve includes one or more structures, such as zippers or other connections, that enable the protective sleeve to be selectively attached to, and detached from, items such as an article of clothing, or equipment such as backpacks;
6. an AAU comprising a protective sleeve made of rip-stop material, Cordura® type fabric, and/or other durable materials (fabrics sold under the Cordura® mark are made at least in part of NYLON, which is a generic designation for a family of synthetic polymers, based on aliphatic or semi-aromatic polyamides);
7. an AAU comprising an airbag assembly that includes an airbag with an outlet connected to a tube having a connector configured to releasably connect to an airbag inflation system;

8. an article of clothing or gear, such as a backpack for example, to which an AAU may be detachably connected; and 9. an AAU that includes an airbag whose fully inflated volume be may in the range of about 10× to 50× the volume occupied by the airbag when the airbag is in a fully deflated state.

BRIEF DESCRIPTION OF THE DRAWINGS

The appended drawings contain figures of some example embodiments to further explain various aspects of the present disclosure. It will be appreciated that these drawings depict only some embodiments of the disclosure and are not intended to limit its scope in any way. The disclosure will be described and explained with additional specificity and detail through the use of the accompanying drawings.

DETAILED DESCRIPTION OF SOME EXAMPLE EMBODIMENTS

Figure 1:
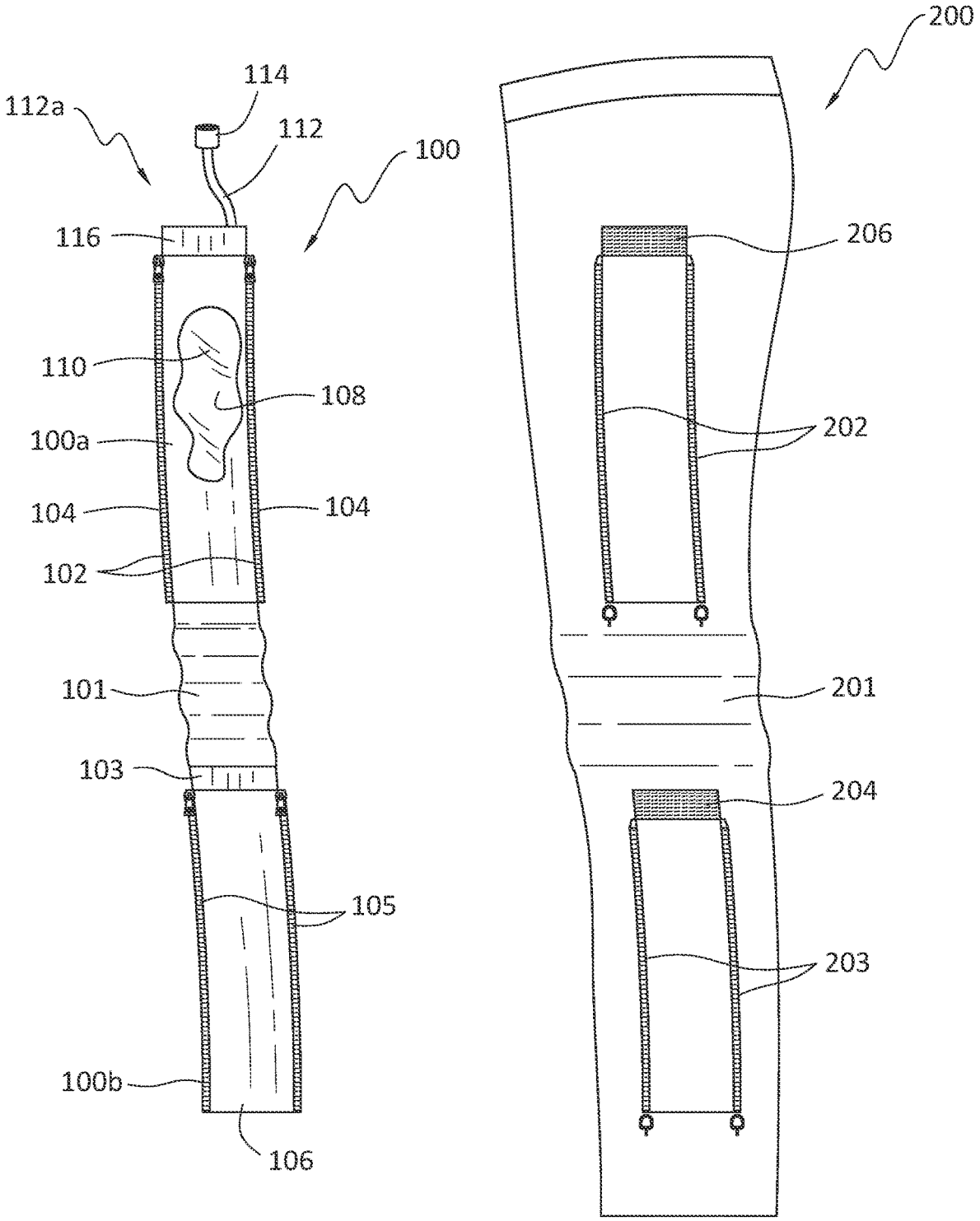
FIGS. 1 discloses aspects of an example ski pant with a detached AAU.

The present disclosure is generally concerned with systems and devices designed to enhance long-term survivability while participating in activities in avalanche-prone venues (for example, alpine downhill skiing, snowboarding, snowmobiling, and mountaineering), and in activities posing a risk for high-impact crashes.

A. Aspects of an Example Embodiment

In general, example embodiments of the invention include a self-contained AAU that may include components enabling the AAU to be detachably attached to clothing and other garments, backpacks, or other equipment. The AAU may be releasably connected, or connectible, to an airbag inflation system, examples of which are disclosed in the Appendix. In some example embodiments, the AAU may include one or more first zipper portions that are releasably engageable with respective one or more second, mating, zipper portions that are attached to, such as by being sewn in, a garment such as ski pants, or a ski jacket, for example. A snap or other retention mechanism may be included, such as on the garment for example, to prevent inadvertent unzipping of the zipper(s). The AAU may include a closure that is configured to retain an airbag within a compartment defined by the AAU, while also being configured to allow ready deployment of the airbag as the airbag is inflated.

Example embodiments of the invention may, but do not necessarily, provide various advantages and benefits. For example, because an AAU may be readily detached from the garment or other item to which it is attached, the garment or other item may be laundered without risk of damage to the AAU and its components. As well, when an AAU is not needed, such as when a skier is only skiing inbounds at a resort where there may be little or no risk to the skier of being caught in an avalanche, the AAU may be removed from the garment or equipment to which it is attached. As another example, an AAU may be connectible to airbag inflation systems, examples of which are disclosed in the Appendix. As a final example, the detachable nature of embodiments of an AAU may make the AAU relatively easy to manufacture, replace if necessary, and/or attach to multiple different garments or gear. For example, if an AAU is damaged beyond repair, a replacement AAU may be readily substituted for the damaged AAU. Thus, the user does not have to replace the entire garment, but only the damaged AAU.

As well, an AAU may be interchangeable between multiple different garments so that the user can purchase a single set of AAUs for use with the different garments or gear. In this way, the user may avoid the expense of purchasing multiple sets of AAUs.

In some embodiments, the AAU may be configured so that when attached to a garment, the entire AAU is positioned on the exterior of the garment. As such, an airbag included as part of an AAU may be positioned within a sleeve or other compartment defined by the AAU but is nonetheless located on the exterior of the garment.

B. Example Materials

Various materials may be used in the construction of the disclosed embodiments. For soft and flexible elements of such embodiments, such as the airbags, clothing pieces, backpacks, and other garments, materials that may be used include, but are not limited to, any combination of textiles and fabrics including nylon, waterproof/water-resistant materials, ripstop materials and other reinforced fabrics, fabric reinforced rubber and other fabric reinforced materials, plastic in sheet or other forms, and rubber, and materials known for use in cold weather equipment and clothing. Tubing, such as that used to convey gas to/from an inflatable bladder or bag, may be made of rubber, plastic, silicone, and/or other suitable materials. In some embodiments at least, the tubing is crush-resistant. Where metal is employed in an embodiment, such as for quick-disconnect fittings for example, such metal may be a metal or metals, including alloys, that is relatively light and strong, such as, but not limited to, titanium or aluminum, for example. As well, some embodiments may employ composite materials including, but not limited to, carbon-based composites or fiberglass composites, wherever relatively light weight, strength, and some degree of stiffness, are needed in a component of an embodiment. Zippers may be made of metal, plastic, or nylon, for example. Hook-and-loop closures may be made of nylon or similar materials. One example of a hook-and-loop closure with complementary attachable/detachable portions is the material sold under the VELCRO® trademark. Waterproof zippers may be employed in some embodiments to reduce, or prevent, ingress of water and other foreign materials to one or more elements of an AAU.

It is noted that any of the airbag compartments included in garments, AAUs, or backpacks disclosed herein may be closed with a suitable closure that is adequate to retain the airbag in the compartment, but which will not impede a deployment of the airbag. One example of such a closure is a hook-and-loop type of closure, but any other closure, such as snaps for example, that will perform the aforementioned functionalities may alternatively be employed. The closure may, or may not, run a majority of a length of the opening to the airbag compartment. Another example closure may comprise one or more sets of magnets of appropriate strength that are adequate to join together to retain the airbag in the compartment but which may be readily separated from each other, thereby allowing airbag deployment, when the airbag is inflated. Other example closures are disclosed elsewhere herein.

Also, the disclosed airbags may be made of any suitable material, examples of which include, nylon, nylon coated with plastic or rubber, plastic, rubber, composite materials, stretched plastic films such as BoPET (a polyester film made from stretched polyethylene terephthalate) that may be sold under the MYLAR mark, as well as any flexible reinforced materials, where such reinforcing may take the form of rip-stop or other fabrics, or any combination of the foregoing. In general, the airbag material may be sufficiently strong and flexible to withstand inflation forces, while also maintaining an inflated state when deployed. The airbag material may be self-sealing from of limited size, and water-resistant or waterproof.

In some embodiments, one or more airbags included in an AAU may have a fully inflated volume in the range of about 10× to about 100× the volume occupied by that airbag when the airbag is fully deflated, or nearly so, such as about 90% deflated. In some embodiments, a total deployed volume of all the airbags employed in an upper garment and a lower garment, combined, may be in the range of about 150 L-170 L. Thus, some airbags may be similar to balloons made of elastic material in that a volume occupied by the fully inflated airbag is substantially greater, anywhere in a range of about 10× up to about 100×, or greater, than a volume occupied by the fully deflated, or nearly deflated, airbag. The total fully inflated volume of all airbags in an embodiment may be selected as needed to suit various circumstances.

In some embodiments, the total fully inflated volume of all airbags in a garment such as a pair of pants, and/or a jacket, for example, may be such as to help ensure that a user does not become entrained in avalanche debris. That is, the total fully inflated volume may be adequate to help a user float upward when the user is caught in an avalanche. This flotation effect may be achieved at least in part because the overall density of the combination of the user+airbag(s) may be relatively lower, possibly substantially lower, than the density of the user, considered alone, and/or because when particles of different sizes are mixed together, the larger particles (such as a human body+airbag(s) tend to rise toward the top of the mixture, while smaller particles tend to fall toward the bottom of the mixture.

To illustrate, the density of atmospheric air at STP (Standard Temperature and Pressure) is about 0.0765 lb./cu. ft., while the average density of a human body is about 63.05 lb./cu. ft., and compacted snow, such as may be encountered in an avalanche, may have a density of about 30.03 lb./cu. ft. (for densities, see: https://www.aqua-calc.com/page/density-table/substance/snow-coma-and-blank-compacted). Thus, the overall density of a human body+airbag(s) may be substantially lower than the density of the human body considered alone. By determining, in some example embodiments, an inflated volume of one or more airbags as a function of the density and/or volume of a human user, the size and/or number of airbags may be determined for one or more embodiments.

In further detail, the fully inflated volume of airbags in some embodiments may be determined as a function of the approximate volume of the user. For example, if it is assumed that an average adult human body has a volume of approximately 75 L (+/−10%), the total fully inflated volume of the airbags in a full body configuration (lower garment+upper garment), or backpack configuration, according to some embodiments, may be in the range of about 2× to 2.5× the volume of the body of the user. In this example then, the fully inflated volume of all the airbags in a full body, or backpack, configuration may be about 150 L to about 188 L. For a partial body configuration, pants only or jacket only, the fully inflated volume of the bags may be about 30% to about 60% of the volume used in a full body configuration.

C. Aspects of Some Example Embodiments

It is noted that while example embodiments are referred to as including "airbags" and using "air" (which refers to atmospheric air), the scope of the invention is not so limited. Rather, and more broadly, any non-explosive and non-toxic gas(es) or combinations of gases, including inert gases such as nitrogen for example, may be used in various embodiments of the invention for the purpose of inflating one or more airbags.

With reference now to FIGS. 1-4, details are provided concerning various example embodiments of the invention. It is noted that, in addition to reference numbers herein and shown in the Figures, the Figures include various other reference elements, as described immediately below.

Figure 2:
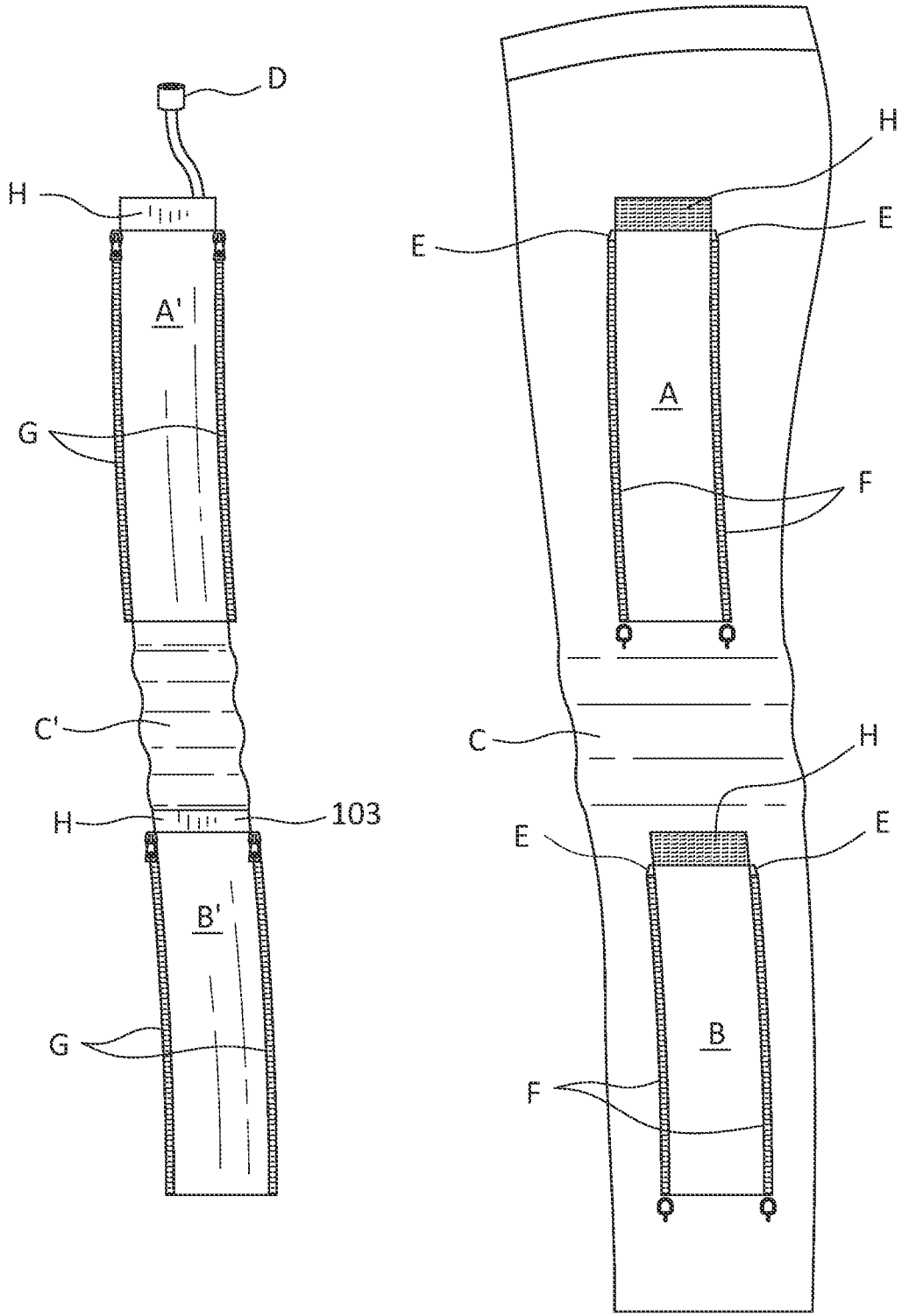
FIG. 2 disclose further aspects of the ski pant and AAU of FIG. 1.

FIG. 2: A—pant wall surface (i.e., bed) over which the upper airbag attachment unit (AAU) may be positioned; A'—proximal (superior) portion of AAU attachable to corresponding area A on pant; B—pant wall surface (i.e., bed) over which the lower airbag attachment unit (AAU) may be positioned; B'—distal (inferior) portion of AAU to be attached to corresponding area B on pant; C—articulated knee portion of pant; C'—corrugated portion of AAU which may overlie freely on C, that is, unattached to C or which may, in other embodiments, be attached to C either permanently, or removably with a connection such as a hook-and-loop connection for example; will contain tube for lower AAU; D—quick-connect tubing (to connect to primary airbag inflation system in user backpack); E—proximal starting point of respective zippers (4); F—zipper/connector mating halves on pants; G—zipper/connector mating halves on AAU; H—aligning mechanism (Velcro, snaps or alike) for proximal portion of superior and inferior components of the AAU and pants to facilitate initiation of zipper attachment.

Figure 3:
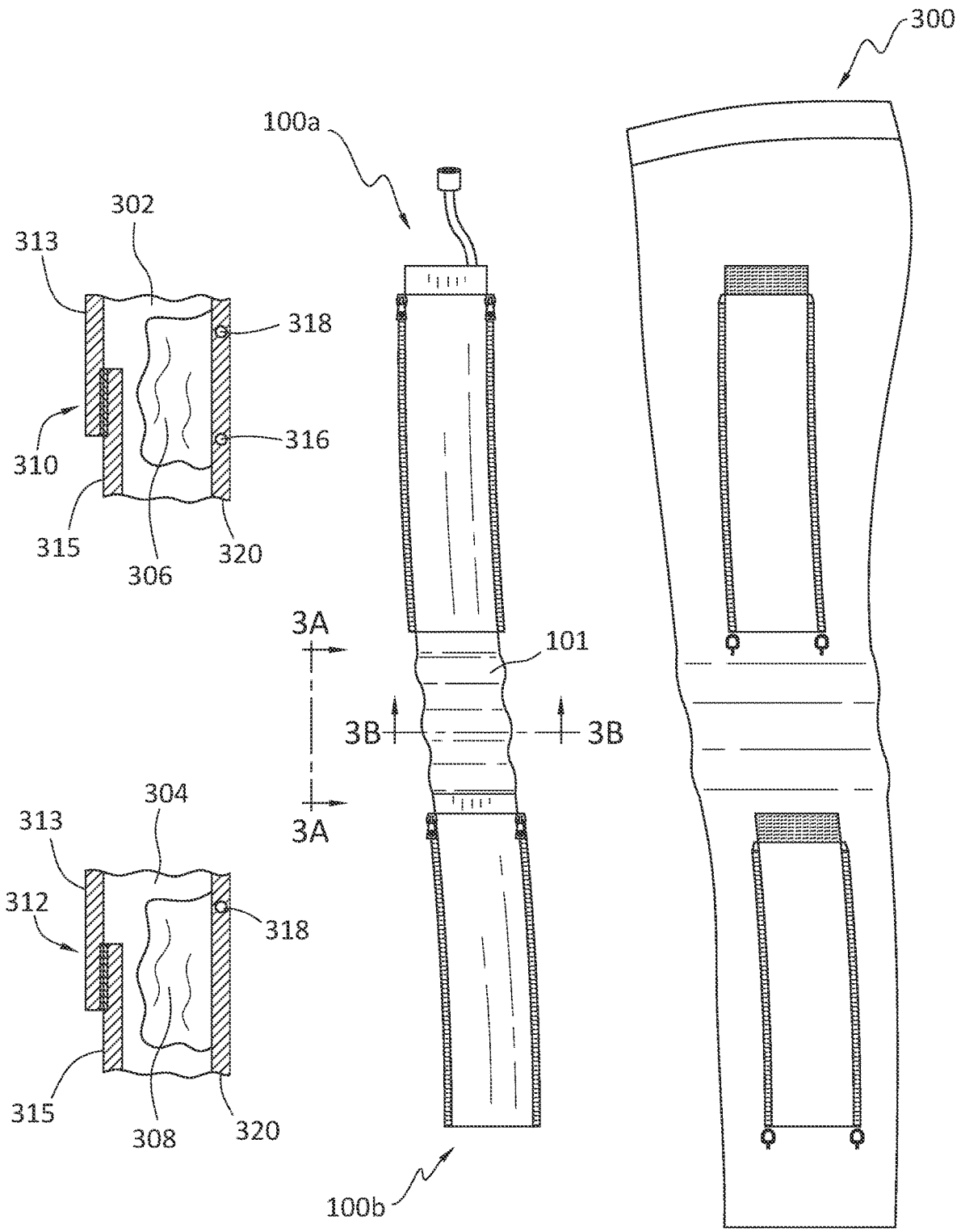
FIG. 3 discloses aspects of an attachable modular unit with airbag compartment(s) and closure of an AAU.

FIG. 3 (Airbag Housing Compartments (cross-section rendering)): Above Knee: a. vest-over-pants closure mechanism for airbag compartment; b. airbag; c. proximal airbag tube and distal airbag tube (medial of airbag); d. Velcro or other attachment mechanism to facilitate the vest-over-pants side closure of AAU; and, Below Knee: a. vest-over-pants closure mechanism for airbag compartment; b. airbag; c. single tube feeding distal airbag only (medial of airbag); and, d. Velcro or other attachment mechanism to facilitate the vest-over-pants side closure of AAU.

In FIGS. 1 and 2, an example AAU is denoted at 100 and may include an upper portion 100*a* connected, or releasably connectible, to a lower portion 100*b*, by way of an articulated portion 101. The AAU 100 may be configured to be detachably connected to an item 200, such as a garment or backpack for example. In the example of FIGS. 1 and 2, the item 200 may comprise, but is not limited to, a pair of ski pants. The AAU 100, particularly upper portion 100*a*, may include a portion of an attachment mechanism 102, such as one or more zipper halves for example, that enables the detachable connection of the AAU 100 to the item 200.

Where the portion of an attachment mechanism 102 comprises a zipper half, the zipper half may be a male half, or a female half. In the illustrated example, the portion of an attachment mechanism 102 comprises two zipper halves, each of which is attached to a respective side 104 of a sleeve 106 that defines an airbag compartment 108 (shown in cutaway; see also FIG. 3) within which one or more airbags 110 may be disposed. The portion of an attachment mechanism 102 may be sewn, or otherwise attached, to the sleeve 106. The portion of an attachment mechanism 102, along with a corresponding or complementary portion of an attachment mechanism 202 on an item, may be collectively referred to herein as an attachment mechanism. That is, an attachment mechanism may comprise two, or more, complementary portions configured to selectively engage with, and be selectively disengaged from, each other, and one of the complementary portions may be attached to the AAU, and another of the complementary portions may be attached to a garment or gear.

With continued reference to FIGS. 1 and 2, the AAU 100 may include a tube 112, or other fluid passageway defining element, that may be made of a flexible material and is connected at a distal end (not shown) to the airbag 110. While not shown in FIGS. 1 and 2 (but see, e.g., FIG. 3*b*), a portion of a tube, such as tube 112, may be housed within a compartment defined within the body of the articulated portion 101 or on the underside of the articulated portion 101. In some embodiments, the portion of the tube that passes through the compartment on the underside of the articulated portion 101 may also be articulated so as to accommodate flexing of the knee or other movement by the user. By partly, or fully, enclosing that portion of the tube that passes beneath the articulated portion 101, the portion of the tube may be prevented from being caught, snagged, or torn out.

The proximal end 112*a* of the tube 112 may include a quick-connect fitting 114, such as a push-to-connect/disconnect fitting for example, that may be selectively connected to an airbag inflation system. Thus, the quick-connect fitting 114, in combination with the portion of an attachment mechanism 102, may enable the AAU 100 to quickly and securely be attached to, and detached from, an airbag inflation system and the item 200, respectively. In more detail, the item 200 may include one or more mating components 202, such as zipper halves for example, configured to releasably engage the portion of the portion of an attachment mechanism 102 of the AAU 100.

As further indicated in FIGS. 1 and 2, where the AAU 100 is employed in connection with an item 200 in the form of ski pants, for example, the configuration of the AAU 100 may be adapted to suit that particular item 200. Particularly, where the item 200 may take the form, for example, of ski pants with an articulated knee portion 201, the item 200 may additionally include one or more mating components 203 positioned below the articulated knee portion 201. The mating components 203 may be separate from, directly connected to, or continuous with, the mating components 202. Correspondingly, the AAU 100 may include an articulated portion 101, underlain at one or both ends with, for example, a respective hook-and-loop portion 103 that may be removably attached to a corresponding hook-and-loop portion 204 that is attached to the item 200. The respective hook-and-loop portions 103/204 may help to retain the AAU 100 in position on the item 200, but without impairing movement of the articulated portions 101/201. Snaps or other selectively releasable fasteners may be used in place of the hook-and-loop portions 103/204. Similar hook-and-loop, or other selectively releasable, fasteners 206 and 116 may be provided at other locations on the item 200 and AAU 100, respectively.

As also indicated in FIGS. 1 and 2, the construction of the AAU 100 may be similar to that of the item 200, at least insofar as the portion of an attachment mechanism 105 may be separate from, directly connected to, or continuous with, the portion of an attachment mechanism 102. For example, the articulated portion 101 may be interposed between, and connect, the portion of an attachment mechanism 102 and the attachment mechanism 105. As shown, the attachment mechanism 105 may be attached to a lower portion 100*b* of the AAU 100, as also indicated in FIG. 3, discussed below.

With reference now to FIG. 3, details are provided concerning an example AAU 300. As shown in the cutaway views 'A' and 'B,' the AAU 300 may define one or more airbag compartments 302 and 304 that may, or may not, communicate with each other. For example, an item that includes an articulated portion may have two or more airbag compartments, one on either side of the articulated portion, that are separate from each other and unconnected to each other.

In the example of FIG. 3, each of the airbag compartments 302 and 304 may house a respective airbag 306 and 308. As well, the airbag compartments 302 and 304 may have respective 'vest-over-pants,' or flap, closures 310 and 312 in which one portion 313 of the airbag compartment 302/304 overlaps another portion 315 of the airbag compartment 302/304. The overlapping portions 313/315 may have respective closure elements, such as hook-and-loop material or snaps for example, that enable the overlapping portions 313/315 to be detachably connected to each other. In general, the strength of the closure may be such as to keep snow and other foreign matter out, while retaining the airbags 306 and 308 in place until they are inflated. As well, the strength of the closures may be such as to resist inadvertent opening of the airbag compartments 302/304, without presenting any material impediment to the ready deployment of the airbags 306/308 should an airbag inflation system be activated and the airbags 306/308 inflated.

As further indicated in FIG. 3, the airbag 306 may be connected to a proximal tube 316, while the airbag 308 may be connected to a distal tube 318, such that air or other gase(es) from an airbag inflation system (not shown) may be supplied to the airbags 306 and 308. Both the proximal tube 316 and distal tube 318 may be carried by the AAU 300, and may be positioned within, or outside of, the airbag compartments 306/308. In the example of FIG. 3, the proximal tube 316 and distal tube 318 are carried in a wall 320 of the AAU 300. The wall 320, which may be rubber, foam rubber, plastic, and/or, other material(s), may comprise a portion of a sleeve of the AAU 300, and the sleeve may comprise a material that is able to flex together with the proximal tube 316 and distal tube 318 to avoiding kinking or pinching of the proximal tube 316 and distal tube 318.

In some embodiments, the proximal tube 316 and distal tube 318 may be connected together (not shown), such as with a Y-connection for example, and the remaining leg of the Y-connection is fitted with a quick connect fitting, such as the quick-connect fitting 114 for example, for connection to an airbag inflation system. In other embodiments, the Y-connection may be located at a distal end of the proximal tube 316 and connected there to the distal tube 318. No particular arrangement or connection of the proximal tube 316 and distal tube 318 is required.

Figure 3A:
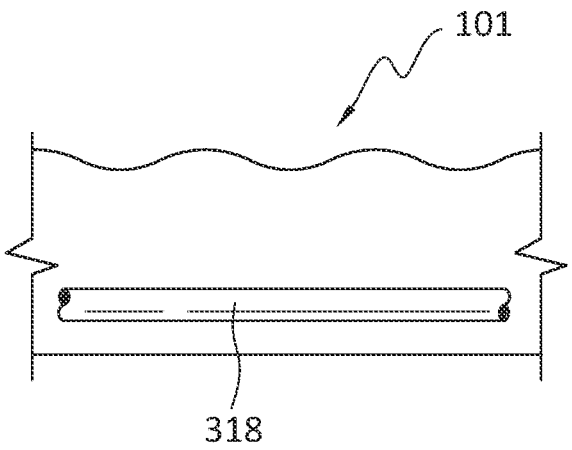
FIGS. 3A and 3B disclose aspects of an airbag compartment of an AAU.
Figure 3B:
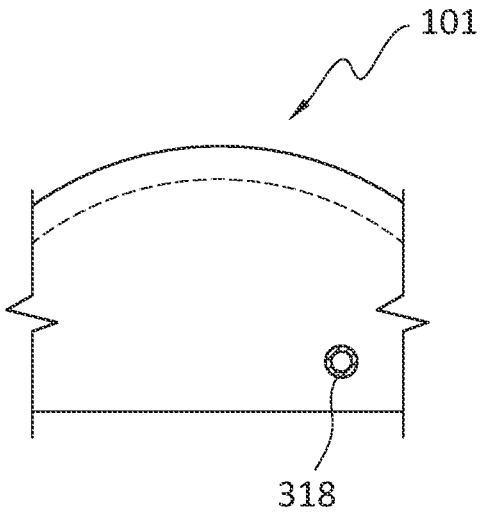

With continued reference to FIG. 3, and directing attention now to FIGS. 3A and 3B as well, further details are provided concerning the articulated portion 101. In general, FIG. 3A is a section view (lengthwise) through the articulated portion 101, while FIG. 3B is a section view (transverse) through the articulated portion 101. The orientation of the distal tube 318 is shown in FIGS. 3A and 3B. In some embodiments, the articulated portion 101 may not be attached to an item, such as the item 500 in FIG. 4 (discussed below), for example. That is, when an AAU is attached to the item and ready for use, the articulated portion 101 may still be able to move freely, at least on the lateral aspect with respect to the item, while the 'corrugated' configuration of the articulated portion 101, and possibly a corrugated or flex portion of the tube 318 as well, enables the user to readily bend and straighten his knee. This configuration may allow the user more freedom of movement around his knee when skiing, riding, or otherwise moving about. In other embodiments, when the AAU is ready for use, the articulated portion 101 may be attached, releasably for example, to the item. Regardless of the embodiment, the articulated portion 101 may comprise stretchable or elastic material, such as an elastic fabric for example, of a fabric that includes elastic elements, although that is not necessarily required.

Figure 4:
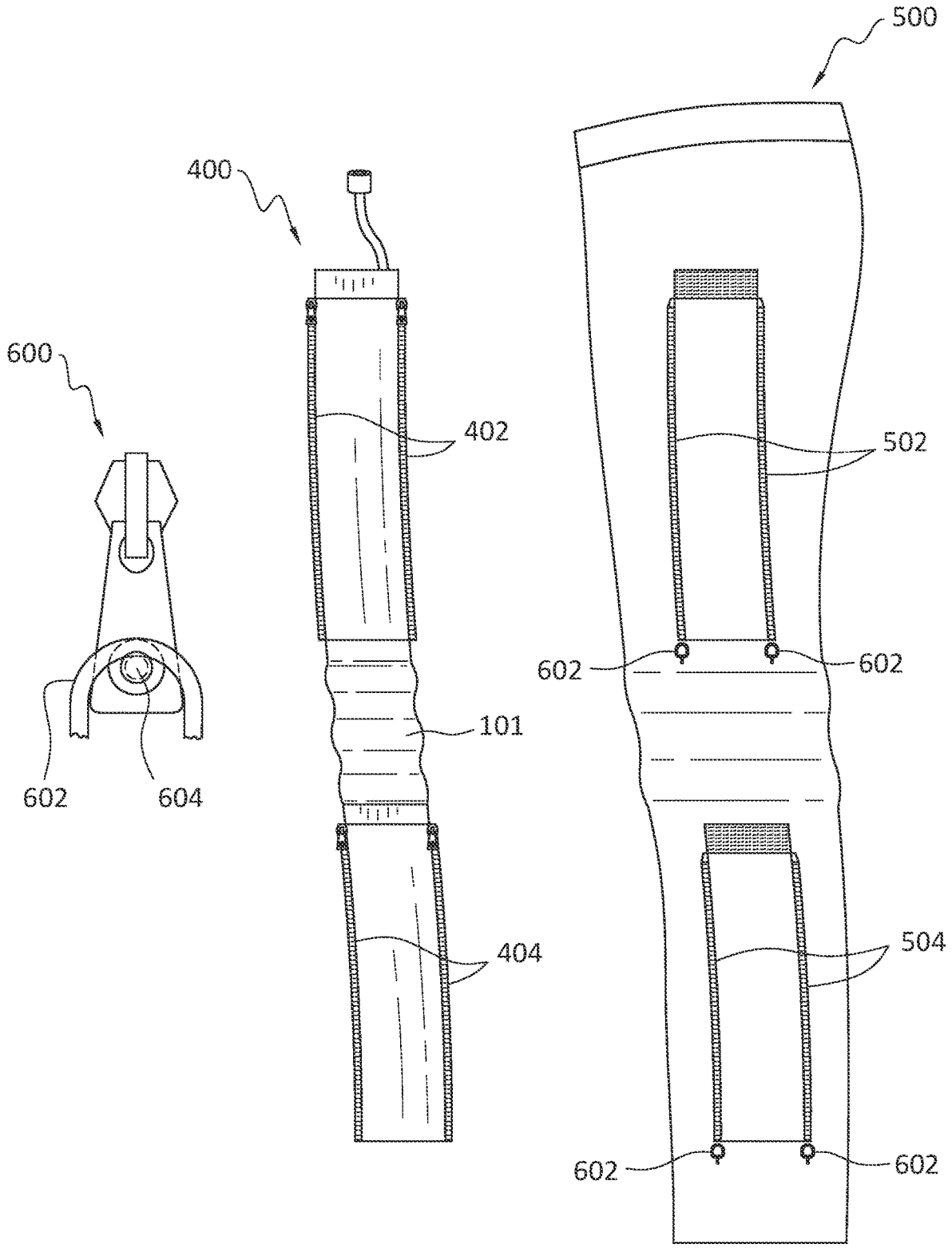
FIG. 4 discloses aspects of an example attachment mechanism and retention device for an AAU.

Turning next to FIG. 4, details are provided concerning an example of a fastener that includes mating components that may be releasably connected to each other, such as engaging portions of a zipper for example. As noted herein, the scope of the invention is not limited to the use of zippers but extends more generally to connecting devices that enable an AAU to be detachably connected to an item such as a garment, or a backpack, for example.

In the example of FIG. 4, an AAU 400 includes two upper mating portions 402 and two lower mating portions 404. The mating portions 402 and 404 are configured and arranged to enable the AAU 400 to be releasably connected to an item 500 that includes corresponding mating portions 502 and 504 configured and arranged to releasably engage the mating portions 402 and 404, respectively. In the illustrated example, a locking attachment 600 is provided that may help to prevent inadvertent disengagement of the mating portions 402/404 from the mating portions 502/504, respectively. One example of such a locking attachment 600 that may be employed in some embodiments of the invention is disclosed in U.S. Pat. No. 5,586,368 (the '368 Patent), where the element 20 of the '368 Patent may be referred to herein as an example of a female portion 602 of a locking attachment 600, and the element 25 of the '368 Patent may be referred to herein as an example of a male portion 604 of a locking attachment 600.

The female portion 602 may be carried by the AAU 400, while the male portion 604 may be carried by the item 500. In other embodiments, the reverse arrangement may be employed. That is, the male portion 604 may be carried by the AAU 400, while the female 602 may be carried by the item 500. No particular arrangement of the female portion 602 and male portion 604 is required however.

In the example of FIG. 4, four locking attachments 600 may be provided, one for each mating portion 402, 404, 502, and 504. In some embodiments, for example, the female portions of 602, which may be elements of the AAU 400, may be connected together so that two adjacent zippers, such as the two zippers above the knee, and the two zippers below the knee, may be operated in tandem. That is, the two zippers may be opened and closed at the same time with a single pulling motion.

Finally, as indicated in FIGS. 1-4 (and FIGS. 5*a*-5*b* discussed below), the size of example AAUs may generally comport with an average size of the anatomy of a user. For example, an AAU, or a portion of an AAU, may have a length such that the AAU extends along a majority of a length of a thigh of an adult user, an AAU, or a portion of an AAU, may have a length such that the AAU extends along a majority of length of a lower leg of an adult user, and an AAU, or a portion of an AAU, may have a length that extends along a majority of a length of an arm of an adult user. To illustrate with one example, in FIG. 1, the AAU 100 may have an overall length that extends along half, or more, of a length of the leg of a user. As well, the upper portion 100*a* of the AAU 100 may have a length that extends along a majority of a length of the thigh of an adult user, and/or the lower portion 100*b* of the AAU 100 may have a length that extends along a majority of a length of the lower leg of an adult user. Because the airbag contained in an AAU may be relatively small as compared with, for example, an airbag contained in a backpack, the AAU itself may be correspondingly small as well, as shown in FIGS. 1-5*b*.

D. Operation of an Example Embodiment

With continued reference to the examples of FIGS. 1-4, it will be appreciated that an AAU may be readily attached to, and detached from, an item. Below is a brief discussion of example attachment and detachment processes.

For example, to attach the AAU 100 to an item, a hook-and-loop portion 116 of the AAU 100 may be releasably attached to a corresponding hook-and-loop portion 206 of an item 200, and a hook-and-loop portion 103 may be attached to a corresponding hook-and-loop portion 204 of the item 200. Next, the mating portions 502 and 402 may be engaged with each other, such as by being zipped together for example. The mating portions 504 and 404 may likewise be engaged with each other, such as by being zipped together. The various locking attachments 600 may then be used to secure the zippers in the closed position. Finally, the AAU 100 may be connected to an airbag inflation system via a quick-connect air coupling mechanism. Removal of the AAU 100 from the item 200 may proceed in the reverse order of that just described, although no particular method of attachment, or detachment, of an AAU is required.

E. Further Aspects of Some Example Embodiments

Details are now provided concerning some further aspects of example embodiments, with particular reference to aspects of an example zipper, such as may be used in some embodiments to attach/detach an AAU to/from an item. The zipper may be a bottom-separating zipper, such as may be used in a jacket for example, and may be one-way in the sense that the zipper may be closed from bottom to top. The zipper may be made of a durable and strong material such as nylon, or a molded plastic material. The zipper may be configured to be relatively tight, that is, so as to offer significant resistance to zipper advancement, whether zipping or unzipping, so as to reduce or prevent inadvertent zipper advancement. A waterproof zipper may possess such resistance. In some embodiments, a zipper garage may be provided in the AAU and/or item to which the AAU is attached so as to protect the zipper, prevent ingress of foreign matter, and/or, prevent inadvertent unzipping of the zipper. The a zipper may include or otherwise be associated with a locking attachment.

Figure 5A:
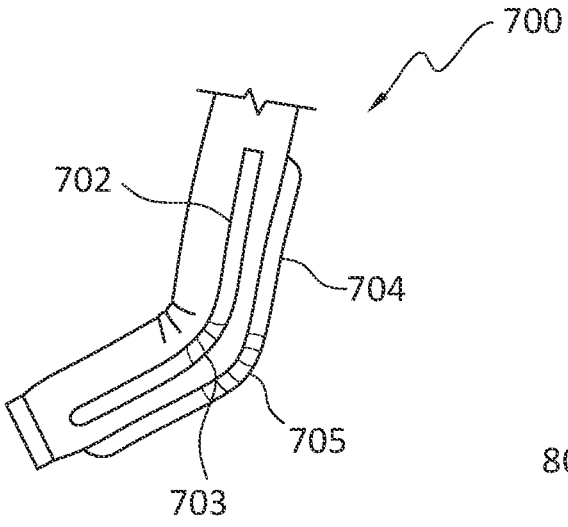
FIG. 5A discloses aspects of a configuration that includes a jacket sleeve and an AAU.
Figure 5B:
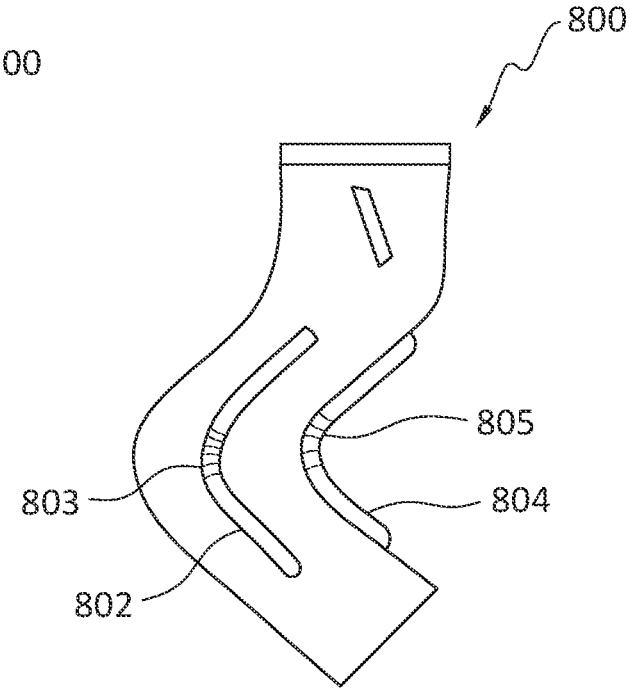
FIG. 5B discloses aspects of a configuration that includes a jacket sleeve and an AAU.

With reference finally to FIGS. 5A and 5B, embodiments of the invention further include articles of clothing to which an airbag attachment unit may be connected in a lateral position and/or a posterior position. With reference first to FIG. 5A, a portion of a jacket, namely, a left sleeve 700, is disclosed. As shown, an airbag attachment unit 702 may be positioned on the lateral aspect of the left sleeve 700. Additionally, or alternatively, an airbag attachment unit 704 may be positioned on the posterior aspect of the left sleeve 700. A right sleeve (not shown) of a jacket may be similarly configured with an airbag attachment unit 702 and/or an airbag attachment unit 704. As shown, the airbag attachment units 702 and 704 may comprise respective articulated portions 703 and 705, respectively, that may generally align with the elbow of the left sleeve 700, and a similar configuration and arrangement may be employed for the right sleeve (not shown). The airbag attachment unit 702 and/or the airbag attachment unit 704 may be any of the disclosed airbag attachment units.

With reference next to FIG. 5B, a portion of a pair of pants, namely, a left leg 800, is disclosed. As shown, an airbag attachment unit 802 may be positioned on the lateral aspect of the left leg 800. Additionally, or alternatively, an airbag attachment unit 804 may be positioned on the posterior aspect of the left leg 800. A right leg (not shown) of a pair of pants may be similarly configured with an airbag attachment unit 802 and/or an airbag attachment unit 804. As shown, the airbag attachment units 802 and 804 may comprise respective articulated portions 803 and 805, respectively, that may generally align with the knee of the left leg 800, and a similar configuration and arrangement may be employed for the right leg (not shown). The lateral airbag attachment unit 802 and/or the airbag attachment unit 804 may be any of the disclosed airbag attachment units.

F. Further Example Embodiments

Following are some further example embodiments of the invention. These are presented only by way of example and are not intended to limit the scope of the invention in any way.

Embodiment 1. An airbag attachment unit (AAU), comprising: a body that defines an airbag compartment; an airbag disposed in the airbag compartment and configured to be selectively deployed from the airbag compartment; a closure mechanism configured to releasably close the airbag compartment; a tube at least partly disposed within the airbag compartment and connected to the airbag, and the tube having a quick-connect coupling mechanism configured to mate with a corresponding element of an airbag inflation system; and a portion of an attachment mechanism connected to the body and configured to releasably engage a corresponding portion of an attachment mechanism of an article of clothing such that the airbag attachment unit is detachably connectible to an exterior of the article of clothing or another item.

Embodiment 2. The airbag attachment unit of embodiment 1, wherein the attachment mechanism comprises respective portions of one or more zippers configured to releasably engage the mating component of the article of clothing.

Embodiment 3. The airbag attachment unit of any of embodiments 1-2, further comprising a releasable locking attachment with a first portion carried by the airbag attachment unit and a complementary second portion carried by the article of clothing.

Embodiment 4. The airbag attachment unit of any of embodiments 1-3, wherein the airbag attachment unit includes an articulated portion, within which is contained tubing for a distal airbag compartment.

Embodiment 5. The airbag attachment unit of any of embodiments 1-4, wherein the airbag attachment unit and item include respective portions of an aligning mechanism configured to align respective proximal portions of superior and inferior components of the airbag attachment unit and pants to facilitate connection together of the respective portions of the attachment mechanism, and the respective portions are configured to detachably attach to each other.

Embodiment 6. The airbag attachment unit of any of embodiments 1-5, wherein the airbag attachment unit includes an upper portion and a lower portion that are connected to each other by an intervening articulated portion, and an airbag and a portion of the tube connected to the airbag are positioned within the lower portion of the airbag attachment unit.

Embodiment 7. The airbag attachment unit of embodiment 6 wherein, in use, the articulated portion is indirectly connected to the article of clothing.

Embodiment 8. The airbag attachment unit of any of embodiments 1-7, further comprising: a second airbag disposed in a second airbag compartment; a second closure configured to releasably close the second airbag compartment; and a second tube connected to at least indirectly to the first tube and to the second airbag, and the second airbag is positioned downstream of the first airbag.

Embodiment 9. The airbag attachment unit of any of embodiments 1-8, wherein part of the tube is carried in a wall of the airbag attachment unit.

Embodiment 10. The airbag attachment unit of any of embodiments 1-9, wherein the airbag compartment and/or the tube are configured to change their respective configurations in response to movements of a user.

Embodiment 11. The airbag attachment unit of any of embodiments 1-10, wherein the article of clothing is a pair of ski or snowboarding pants, a pair of pull-over pants, a ski jacket, or other external apparel usable in snow sports or non-snow sports activities.

Embodiment 12. The airbag attachment unit of any of embodiments 1-11, wherein the article of clothing is a jacket, and the airbag attachment unit comprises upper and lower portions connected to each other by an articulated portion, and the airbag attachment unit is configured so that when it is attached to the item, the articulated portion is laterally or posteriorly positioned proximate a portion of an elbow area of the jacket.

Embodiment 13. The airbag attachment unit of any of embodiments 1-12, wherein the article of clothing is a pair of pants, and the airbag attachment unit comprises upper and lower portions connected to each other by an articulated portion, and the airbag attachment unit is configured so that when it is attached to the item, the articulated portion is laterally or posteriorly positioned proximate a portion of a knee area of the pants.

Embodiment 14. A pair of pants, comprising: a first pant leg; and a second pant leg connected at least indirectly to the first pant leg; and first and second airbag attachment units (AAU), wherein each of the first and second airbag attachment units comprises: a body that defines an airbag compartment; an airbag disposed in the airbag compartment and configured to be selectively deployed from the airbag compartment; a closure mechanism configured to releasably close the airbag compartment; a tube at least partly disposed within the airbag compartment and connected to the airbag, and the tube having a quick-connect coupling mechanism configured to releasably connect with a corresponding element of a backpack airbag inflation system; and a portion of an attachment mechanism connected to the body and configured to releasably engage a corresponding portion of an attachment mechanism of one of the first or second pant legs such that the airbag attachment unit is detachably connectible to an exterior of one of the first or second pant legs.

Embodiment 15. The pair of pants as recited in embodiment 14, wherein each of the first and second airbag attachment units comprises upper and lower portions connected to each other by an articulated portion, and each of the airbag attachment units is configured so that when it is attached to either the first pant leg or the second pant leg, the articulated portion is laterally or posteriorly positioned proximate a portion of a knee area of the pair of pants.

Embodiment 16. The pair of pants as recited in embodiment 15, wherein one of the first airbag attachment unit and the second airbag attachment unit further comprises: a second airbag disposed in a second airbag compartment; a second closure configured to releasably close the second airbag compartment; and a second tube connected to at least indirectly to the first tube and to the second airbag, and the second airbag is positioned downstream of the first airbag.

Embodiment 17. The pair of pants as recited in embodiment 15, wherein one of the first airbag attachment unit and the second airbag attachment units further comprises a releasable locking attachment with a first portion carried by that airbag attachment unit and a complementary second portion carried by the pair of pants.

Embodiment 18. The pair of pants as recited in embodiment 15, wherein the first one of the airbag attachment units comprises upper and lower portions connected to each other by an articulated portion, and the first airbag attachment unit is configured so that when it is attached to the pair of pants, the articulated portion is laterally or posteriorly positioned proximate a portion of a knee area of the pair of pants.

Embodiment 19. The pair of pants as recited in embodiment 15, wherein part of the tube of the second airbag attachment unit is carried in a wall of the first airbag attachment unit.

Although this disclosure has been described in terms of certain example embodiments, other embodiments apparent to those of ordinary skill in the art are within the scope of this disclosure.

Such embodiments may include, but are not limited to, the following: 1. widow variation in number of airbags per AAU: one above the knee, one below the knee, or one above the knee only, or one below the knee only; 2. variation in airbag compartment locations per AAU: lateral to the entire lower extremity, or posterior to the entire lower extremity, or any combination thereof; 3. when the item is a jacket, the variations of 1 and 2 above pertain in similar fashion above and below the elbow.

What is claimed is:

1. An airbag attachment unit (AAU), comprising:

a body that defines an airbag compartment;

an airbag disposed in the airbag compartment and configured to be selectively deployed from the airbag compartment;

a closure mechanism configured to releasably close the airbag compartment;

a tube at least partly disposed within the airbag compartment and connected to the airbag, and the tube having a coupling mechanism configured to mate with a corresponding element of an airbag inflation system; and a portion of an attachment mechanism connected to the body and configured to releasably engage a corresponding portion of an attachment mechanism of an article of clothing such that the airbag attachment unit is detachably connectible to an exterior of the article of clothing.

2. The airbag attachment unit of claim 1, wherein the attachment mechanism compromises respective portions of one or more zippers configured to releasably engage the mating component of the article of clothing.

3. The airbag attachment unit of claim 1, further comprising a releasable locking attachment with a first portion carried by the airbag attachment unit and a complementary second portion carried by the article of clothing.

4. The airbag attachment unit of claim 1, wherein the airbag attachment unit includes an articulated portion, within which is contained tubing for a distal airbag compartment.

5. The airbag attachment of claim 1, wherein the airbag attachment unit and item include respective portions of an aligning mechanism configured to align respective proximal portions of superior and inferior components of the airbag attachment unit and pants to facilitate connection together of the respective portions of the attachment mechanism, and the respective portions are configured to detachably attach to each other.

6. The airbag attachment of claim 1, wherein the airbag attachment unit includes an upper portion and a lower portion that are connected to each other by an intervening articulated portion, and an airbag and a portion of the tube connected to the airbag are positioned within the lower portion of the airbag attachment unit.

7. The airbag attachment unit of claim 6 wherein, in use, the articulated portion is indirectly connected to the article of clothing.

8. The airbag attachment unit of claim 1, further comprising: a second airbag disposed in a second airbag compartment;

a second closure configured to releasably close the second airbag compartment; and a second tube connected to at least indirectly to the first tube and to the second airbag, and the second airbag is positioned downstream of the first airbag.

9. The airbag attachment unit of claim 1, wherein part of the tube is carried in a wall of the airbag attachment unit.

10. The airbag attachment unit of claim 1, wherein the airbag compartment and/or the tube are configured to change their respective configurations in response to movements of a user.

11. The airbag attachment unit of claim 1, wherein the article of clothing is a pair of ski or snowboarding pants, a ski jacket, or other external apparel usable in snow sports or non-snow sports activities.

12. The airbag attachment unit of claim 1, wherein the article of clothing is a jacket, and the airbag attachment unit comprises upper and lower portions connected to each other by an articulated portion, and the airbag attachment unit is configured so that when it is attached to the item, the articulated portion is laterally or posteriorly positioned proximate a portion of an elbow area of the jacket.

13. The airbag attachment unit of claim 1, wherein the article of clothing is a pair of pants, and the airbag attachment unit comprises upper and lower portions connected to each other by an articulated portion, and the airbag attachment unit is configured so that when it is attached to the item, the articulated portion is laterally or posteriorly positioned proximate a portion of a knee area of the pants.

14. A pair of pants, comprising:

a first pant leg; and a second pant leg connected at least indirectly to the first pant leg; and first and second airbag attachment units (AAU), wherein each of the first and second airbag attachment units comprises:

a body that defines an airbag compartment;

an airbag disposed in the airbag compartment and configured to be selectively deployed from the airbag compartment;

a closure mechanism configured to releasably close the airbag compartment;

a tube at least partly disposed within the airbag compartment and connected to the airbag, and the tube having a coupling mechanism configured to releasably connect with a corresponding element of a backpack airbag inflation system; and a portion of an attachment mechanism connected to the body and configured to releasably engage a corresponding portion of an attachment mechanism of one of the first or second pant legs such that the airbag attachment unit is detachably connectible to an exterior of one of the first and second pant legs.

15. The pair of pants as recited in claim 14, wherein each of the first and second airbag attachment units comprises upper and lower portions connected to each other by an articulated portion, and each of the airbag attachment units is configured so that when it is attached to either the first pant leg or the second pant leg, the articulated portion is laterally or posteriorly positioned proximate a portion of a knee area of the pair of pants.

16. The pair of pants as recited in claim 15, wherein one of the first airbag attachment unit and the second airbag attachment unit further comprises:

a second airbag disposed in a second airbag compartment;

a second closure configured to releasably close the second airbag compartment; and a second tube connected to at least indirectly to the first tube and to the second airbag, and the second airbag is positioned downstream of the first airbag.

17. The pair of pants as recited in claim 15, wherein one of the first airbag attachment unit and the second airbag attachment unit further comprises a releasable locking attachment with a first portion carried by that airbag attachment unit and a complementary second portion carried by the pair of pants.

18. The pair of pants as recited in claim 15, wherein the first one of the airbag attachment units comprises upper and lower portions connected to each other by an articulated portion, and the first airbag attachment unit is configured so that when it is attached to the pair of pants, the articulated portion is laterally or posteriorly positioned proximate a portion of a knee area of the pair of pants.

19. The pair of pants as recited in claim 15, wherein part of the tube of the first airbag attachment unit is carried in a wall of the first airbag attachment unit.

* * * * *